US007008443B2

(12) United States Patent
Jakubow

(10) Patent No.: US 7,008,443 B2
(45) Date of Patent: Mar. 7, 2006

(54) STEAM GENERATING APPARATUS FOR SKIN CARE

(76) Inventor: Rafael Jakubow, 465 Golden Beach Dr., North Miami, FL (US) 33160

( * ) Notice: Subject to any disclaimer, the term of this patent is extended or adjusted under 35 U.S.C. 154(b) by 0 days.

(21) Appl. No.: 10/008,095

(22) Filed: Nov. 9, 2001

(65) Prior Publication Data

US 2003/0093014 A1 May 15, 2003

(51) Int. Cl.
*A61H 33/12* (2006.01)
*A61H 35/00* (2006.01)

(52) U.S. Cl. ..... 607/84; 607/109; 607/104; 604/24; 604/291; 604/289; 4/537; 34/97

(58) Field of Classification Search ..... 607/84, 607/96, 104, 108, 109; 604/23, 24, 289, 604/291; 4/537; 34/96–101
See application file for complete search history.

(56) References Cited

U.S. PATENT DOCUMENTS 3,707,971 A * 1/1973 Yamamoto ..... 607/84
4,553,339 A * 11/1985 Rigo ..... 34/99
5,607,409 A * 3/1997 John ..... 604/289
5,984,952 A * 11/1999 Chang ..... 607/109

* cited by examiner

*Primary Examiner*—Danton D. DeMille
(74) *Attorney, Agent, or Firm*—Frank L. Kubler

(57) ABSTRACT

An apparatus for generating a stream of steam for direction against an area of skin of a person includes a water vessel for retaining a quantity of water, the vessel having an upright tubular vessel side wall and a vessel bottom wall and a vessel mounting structure, and a water heating mechanism mounted outside and in thermal proximity to the vessel including a heating element and a power source connection structure for generating heat for transfer into the water vessel to heat the quantity of water sufficiently to progressively transform the quantity of water into a stream of steam; a steam guidance framework including a vessel cover structure having a structure upper surface and a structure lower surface, a vessel engaging structure for suspending the vessel from the vessel cover structure, the vessel cover structure having a steam port over the water vessel for passing a stream of steam from the water vessel; a steam delivery tube including a steam delivery tube receiving end and a steam delivery tube discharge end, the steam delivery tube receiving end being sealingly affixed to the structure upper surface and positioned to enclose the steam port, the steam delivery tube protruding from the structure upper surface to the delivery tube discharge end, the delivery tube discharge end including a steam discharge port for orientation toward a selected area of the skin of a person to direct the stream of steam against the selected area of skin.

4 Claims, 6 Drawing Sheets

STEAM GENERATING APPARATUS FOR SKIN CARE

BACKGROUND OF THE INVENTION

1. Field of the Invention

The present invention relates generally to the field of skin care and treatment. More specifically the present invention relates to an apparatus for generating a stream of steam for direction against a region of skin of a person for cosmetic treatment of the skin. The apparatus includes a stainless steel water vessel for retaining a quantity of water having an upright tubular vessel side wall with a laterally protruding U-shaped handle, and includes a vessel bottom wall, vessel mounting means and a water heating mechanism mounted to the exterior of and in thermal proximity to the vessel including a heating element and power source connection means for generating and transferring heat into the water vessel to heat the quantity of water sufficiently to progressively transform the quantity of water into steam. The apparatus further includes a steam guidance framework including a substantially horizontal vessel cover structure having a structure upper surface and a structure lower surface, vessel engaging means for suspending the vessel from the vessel cover structure, the vessel cover structure having a steam port above the mounted water vessel for passing a stream of steam as the steam is formed within the water vessel, a steam delivery tube sealingly affixed at a steam delivery tube receiving end to the structure upper surface of the vessel cover structure and positioned to enclose the stream port, the delivery tube preferably protruding upwardly and laterally from the vessel cover structure upper surface to a delivery tube discharge end which includes a steam discharge port for orientation toward the skin of the person to direct the stream of steam against the user skin.

The delivery tube optionally includes an ozone receiving port and an ozone generator mounted to the side of the delivery tube and in fluid communication with the ozone receiving port to pass ozone into the stream of steam flowing through the delivery tube to the steam discharge port. The delivery tube free end is preferably closed with a tube end wall and the steam discharge port preferably opens out of the side of the steam delivery tube.

2. Description of the Prior Art

There have been steam generating devices for generating and directing a stream of steam against an area of user skin. A typical example of prior steam generating devices is that of VAPOR™ by SILVERTONE™, which includes a framework F with a platform P and a heating element structure E connected to and extending downwardly from the platform P lower surface, a water jar J and jar clamping means C for sealingly mounting the water jar J to the platform P lower surface so that the jar J encloses the heating element the heating element structure E is submerged in water placed within the jar J. See Prior Art FIGS. 1 and 2. Steam from the water heated by the heating element passes out of the water jar J through a steam port SP in the platform P into a metal steam delivery tube T protruding upwardly and laterally from the platform upper surface. A problem with VAPOR™ is that the water in the water jar J is in direct contact with the heating element structure E and the heat causes the structure E to corrode at a highly accelerated rate. As a result these costly and difficult to install heating element structures E must replaced relatively frequently. Furthermore, this arrangement makes ordinary tap water unsuitable so that distilled water must be available continually. More importantly, some of the heating element structure E corrosion escapes from the jar J and coats inner surfaces of the steam port and steam delivery tube T. This accumulated corrosion creates obstructing clogs which make the steam flow irregular and unpredictable, and as a result the device can clog and then "spit", that is, discharge a spray of condensed and scalding water onto the skin of a user, causing injury and creating liability for the solon. The water jar J is also relatively time consuming and awkward to remove and refill, because the jar J must be lowered by the clamp C sufficiently to clear the downwardly protruding heating element structure E.

It is thus an object of the present invention to provide a steam generating apparatus for skin care into which water can be rapidly and easily replenished.

It is another object of the present invention to provide such an apparatus which transforms ordinary tap water into steam and delivers the steam in a steady and safe stream, free of clogging, condensate formation and spitting.

It is still another object of the present invention to provide such an apparatus which is durable and reliable.

It is finally an object of the present invention to provide such an apparatus which is relatively inexpensive to manufacture.

SUMMARY OF THE INVENTION

The present invention accomplishes the above-stated objectives, as well as others, as may be determined by a fair reading and interpretation of the entire specification.

An apparatus is provided for generating a stream of steam for direction against an area of skin of a person, the apparatus including a water vessel for retaining a quantity of water, the vessel having an upright tubular vessel side wall and a vessel bottom wall and a vessel mounting structure, and a water heating mechanism mounted outside and in thermal proximity to the vessel including a heating element and a power source connection structure for generating heat for transfer into the water vessel to heat the quantity of water sufficiently to progressively transform the quantity of water into a stream of steam; a steam guidance framework including a vessel cover structure having a structure upper surface and a structure lower surface, a vessel engaging structure for suspending the vessel from the vessel cover structure, the vessel cover structure having a steam port over the water vessel for passing a stream of steam from the water vessel; a steam delivery tube including a steam delivery tube receiving end and a steam delivery tube discharge end, the steam delivery tube receiving end being sealingly affixed to the structure upper surface and positioned to enclose the steam port, the steam delivery tube protruding from the structure upper surface to the delivery tube discharge end, the delivery tube discharge end including a steam discharge port for orientation toward a selected area of the skin of a person to direct the stream of steam against the selected area of skin.

The vessel mounting structure preferably includes a vessel supporting flange extending radially outwardly from the vessel side wall; two spaced apart and opposing mounting flange receiving channels secured to and extending from the vessel cover structure, oriented to open toward each other and positioned to receive a vessel gasket on the vessel cover structure lower surface; and a vessel clamp affixed to and protruding downwardly from the vessel cover structure for receiving the vessel and for pressing the vessel upwardly so that the vessel rim is sealingly pressed against the vessel gasket.

The vessel clamp preferably includes at least one clamp arm having an arm lower end and extending downwardly from the vessel cover structure and bent generally horizontally at the arm lower end at which is connected a clamp screw nut structure having an upright and internally threaded clamp screw bore; and a threaded clamp shaft rotatably and engagingly passing through the screw bore, the clamp shaft having a shaft lower end fitted with a hand grip structure for rotating the clamp shaft and having a shaft upper end; so that the vessel is insertable adjacent to the at least one clamp arm, and the clamp shaft is rotated so that the clamp shaft advances upwardly to cause the shaft upper end to bear against the vessel and elevate the vessel until the vessel rim bears sealingly against the vessel gasket so that steam escaping from the vessel is constrained to pass through the steam port and into the steam delivery tube, and so that the clamp shaft is rotatable in the opposite rotational direction with the hand grip structure and the shaft upper end advances downwardly and the vessel is released from compression and freed for removal from the vessel clamp. The vessel preferably is formed of stainless steel so that the vessel is resistant to corrosion induced by heat from the heating element.

The apparatus preferably additionally includes an ozone receiving port in the steam delivery tube and an ozone generator positioned to delivery ozone into the ozone delivery port for passing ozone into the stream of steam flowing through the steam delivery tube. The steam delivery tube free end preferably is closed with a tube end wall and the steam discharge port opens laterally out of the steam delivery tube. The steam delivery tube preferably includes a delivery tube base segment fastened to the vessel cover structure and a delivery tube extension segment secured to the base segment with a tube interconnection structure, the base segment including the ozone port and the extension segment including the steam discharge port. The extension segment preferably includes an extension segment inner tube for containing the stream of steam and an axially concentric extension segment outer tube containing the extension segment inner tube and sized in diameter and positioned to be spaced radially outward from the inner tube for providing a heat insulating air gap between the extension segment inner tube and the extension segment outer tube so that the outer tube is cool enough to be handled for manual positioning of the steam discharge port. The extension segment preferably is axially rotatable at the tube interconnection structure to orient the steam discharge port.

The water heating element preferably includes an electrical resistance heating element. The water vessel preferably includes a handle.

BRIEF DESCRIPTION OF THE DRAWINGS

Various other objects, advantages, and features of the invention will become apparent to those skilled in the art from the following discussion taken in conjunction with the following drawings, in which.

Prior Art

Prior Art

DETAILED DESCRIPTION OF THE PREFERRED EMBODIMENTS

Figure 1:
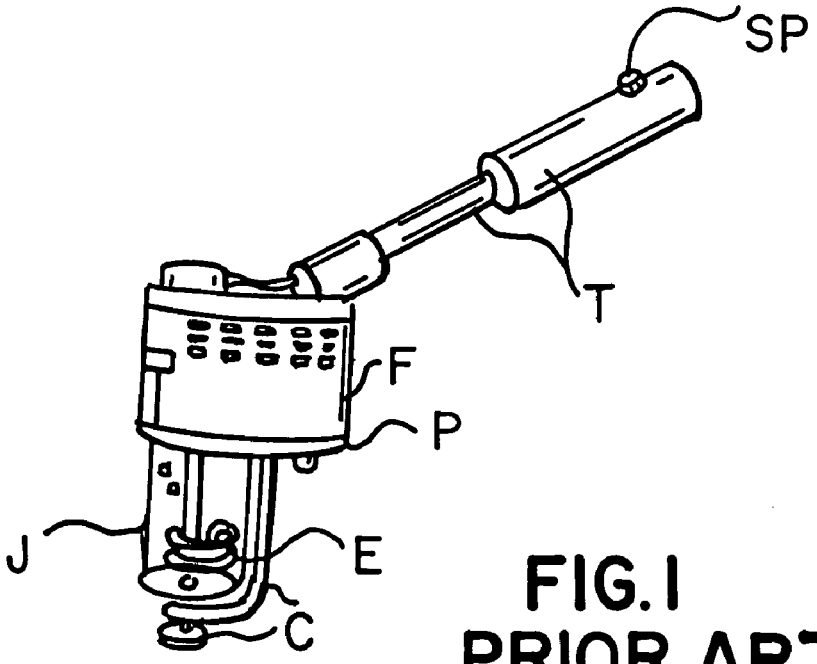
FIG.1 PRIOR ART
FIG. 1 is a side view of a prior art steam generating apparatus.
Figure 2:
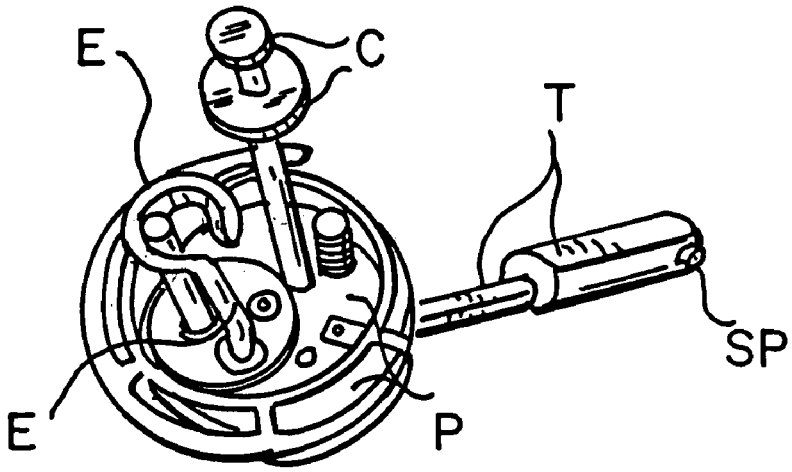
FIG.2 PRIOR ART
FIG. 2 is a perspective bottom view of the steam generating apparatus of FIG. 1 with the water jar removed.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 4:
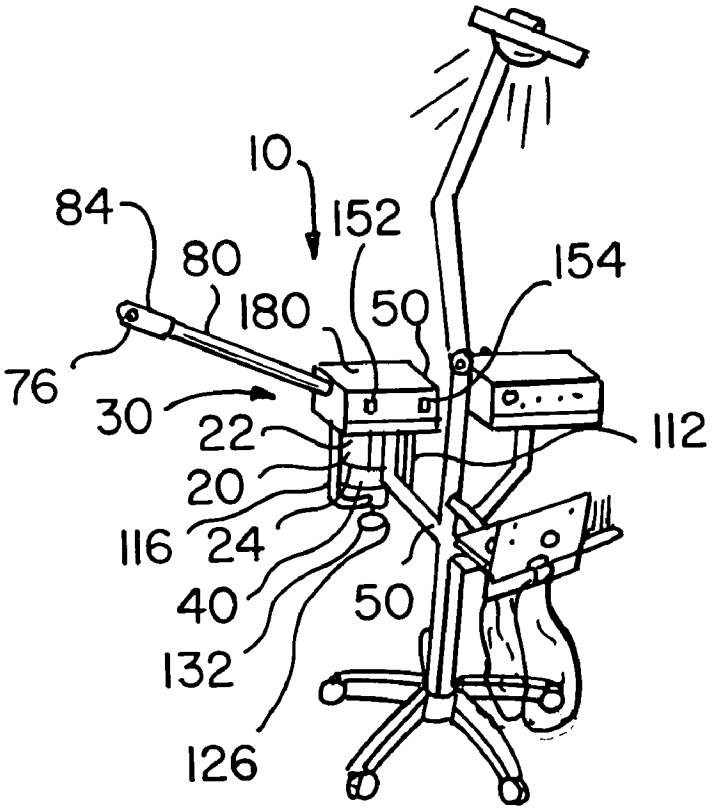
FIG. 4 is a perspective side view of the another preferred embodiment of the inventive steam generating apparatus, combined with other skin solon devices.
Figure 3:
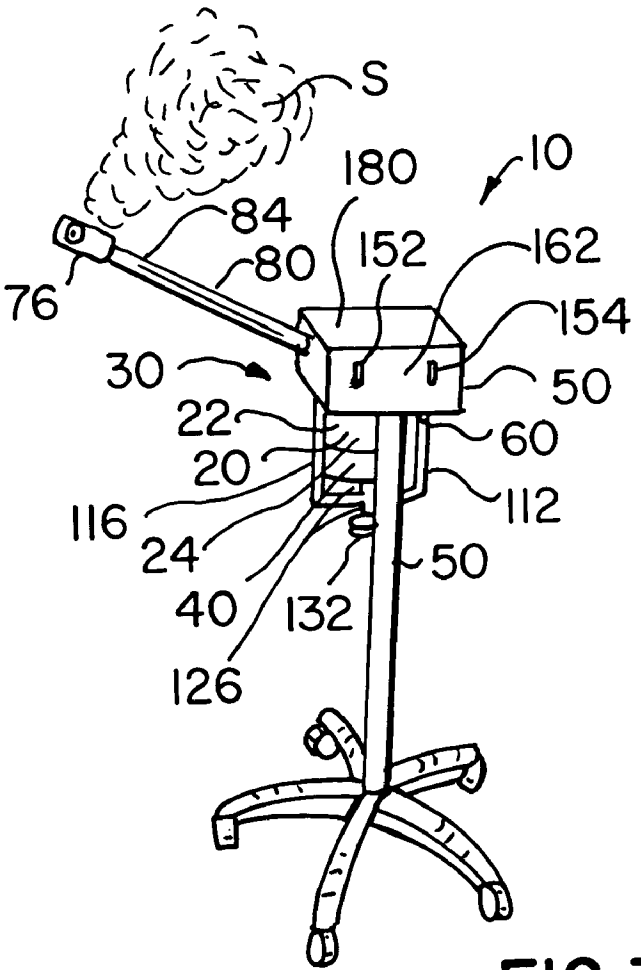
FIG. 3 is a perspective side view of the one preferred embodiment of the inventive steam generating apparatus.
Figure 5:
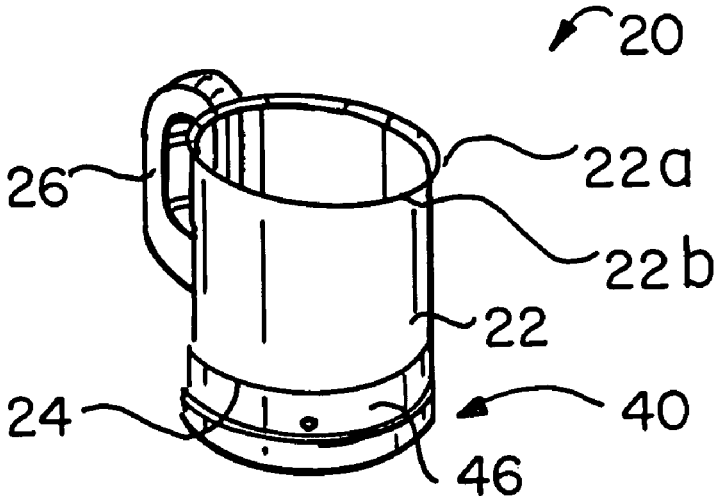
FIG. 5 is a top perspective view of the preferred water vessel and water heating mechanism mounted to the lower surface of the vessel bottom wall.
Figure 6:
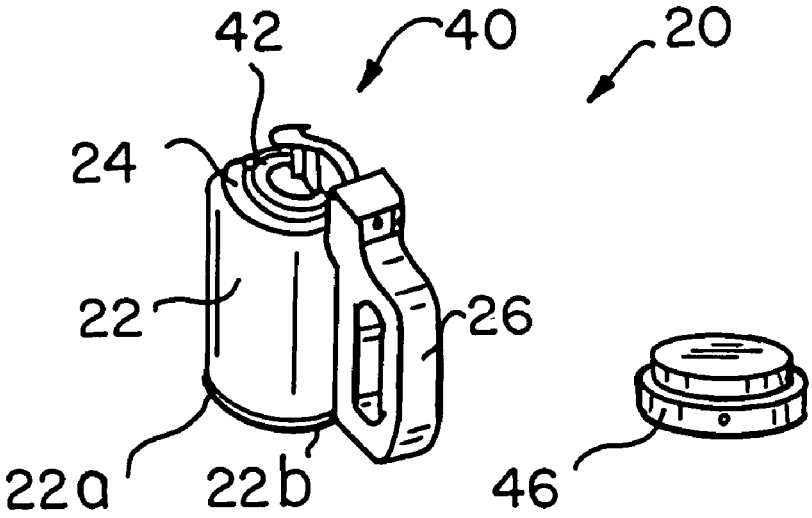
FIG. 6 is a bottom perspective view of the preferred water vessel showing the housing cover portion removed from the heating mechanism, revealing the heating element.
Figure 7:
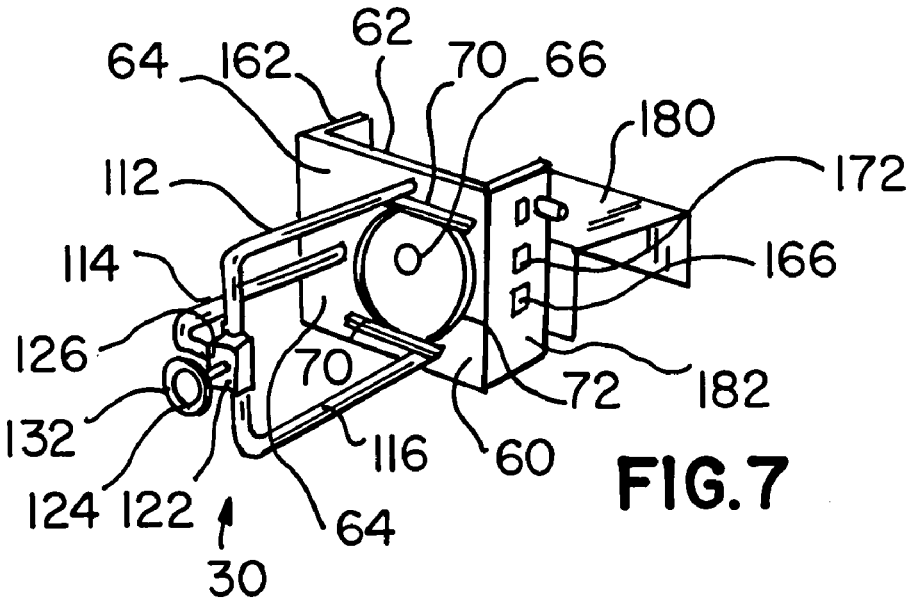
FIG. 7 is a bottom perspective view of the vessel cover structure and vessel clamp, with the housing cover portion removed and positioned beside the vessel cover structure.
Figure 8:
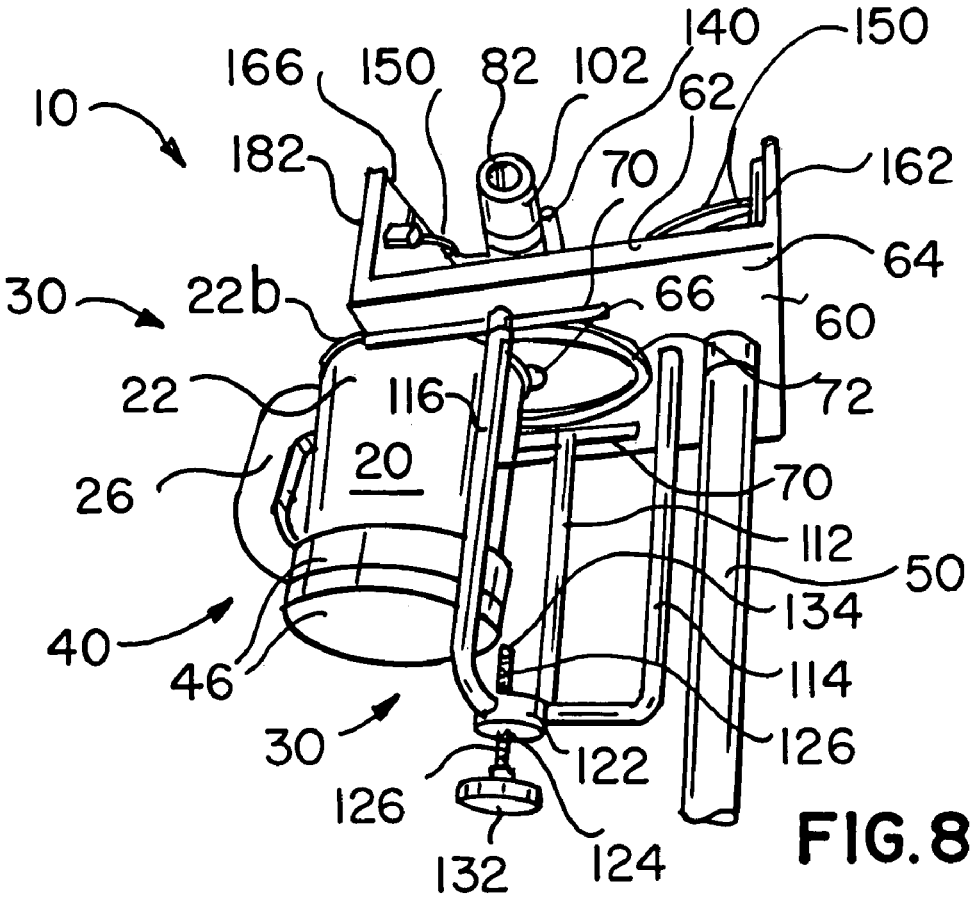
FIG. 8 is a lower side perspective view of the vessel cover structure with the water vessel being inserted into the vessel clamp and the vessel supporting flange being inserted into the opposing vessel suspension channels.
Figure 9:
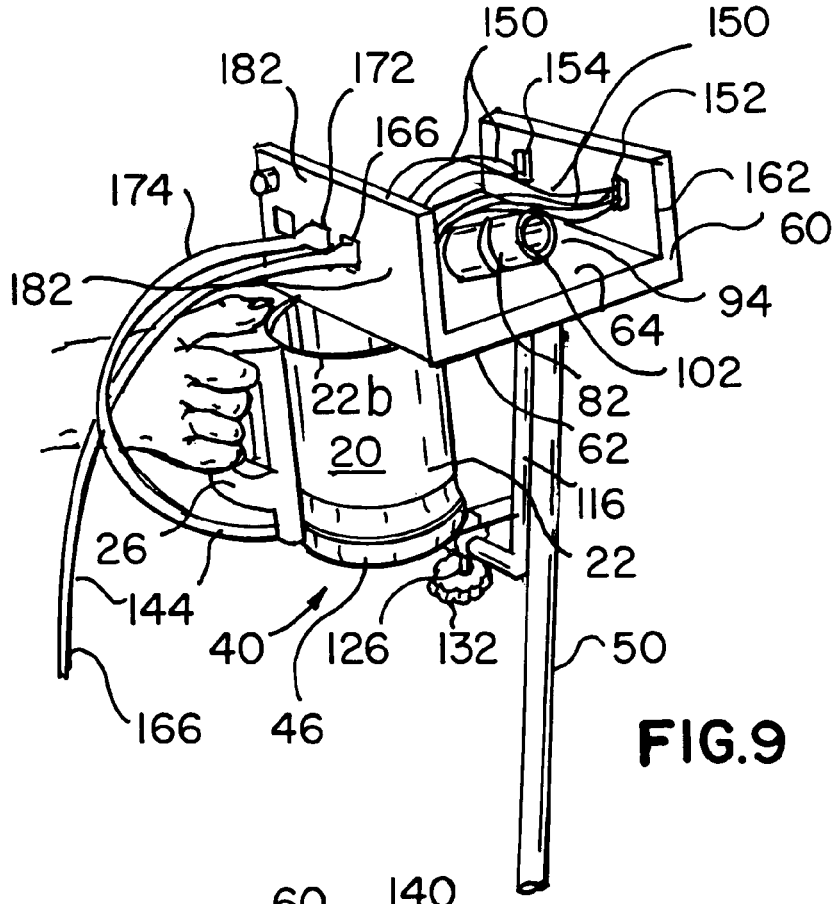
FIG. 9 is an upper side perspective view of the vessel cover structure with the water vessel being inserted as shown in FIG. 8.
Figure 10:
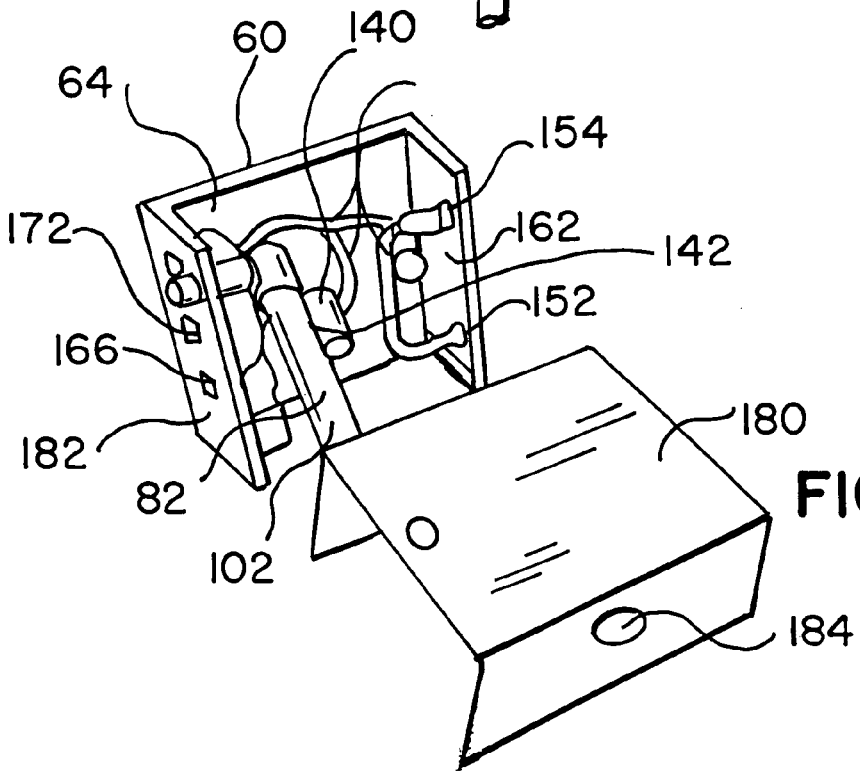
FIG. 10 top perspective view of the vessel cover structure with the housing cover portion removed and resting in front of the vessel cover structure, revealing apparatus circuitry.
Figure 11:
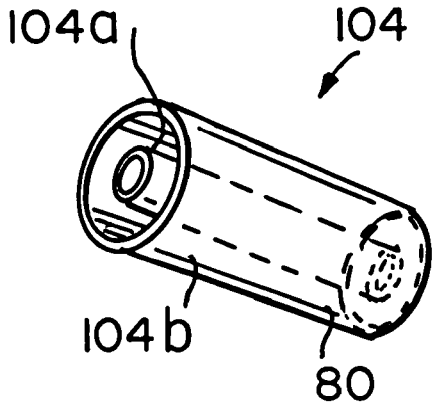
FIG. 11 is a broken away segment of the steam delivery tube extension segment having the preferred inner and outer tubes.
Figure 12:
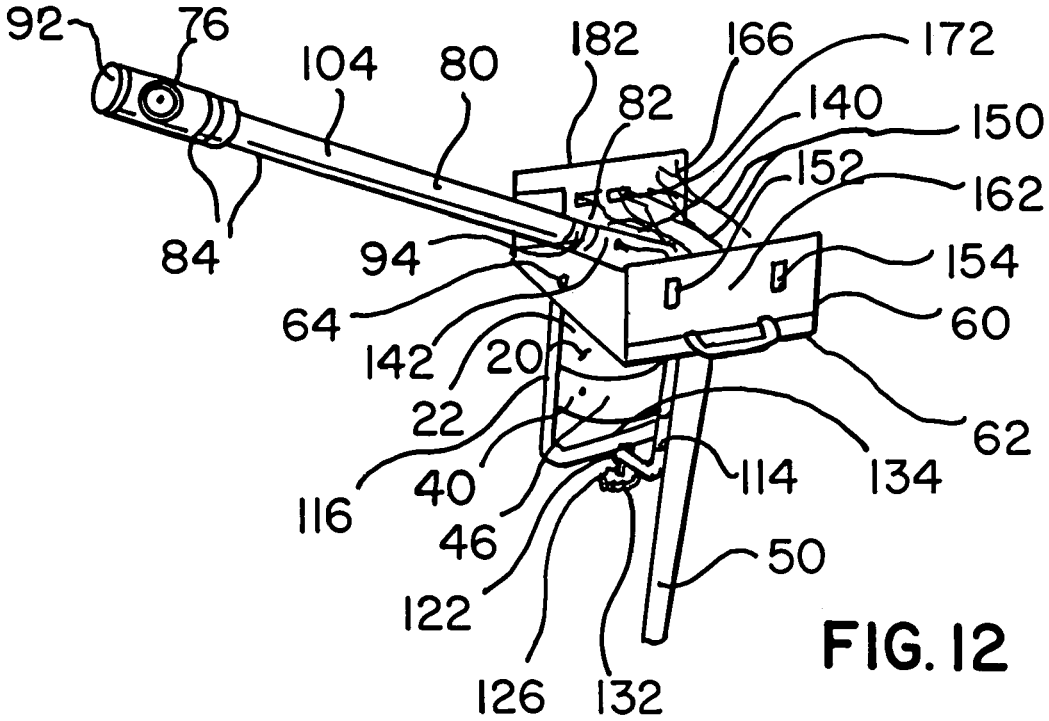
FIG. 12 is a perspective view of the apparatus with the vessel housing cover portion removed.

Referring to FIGS. 3–12, an apparatus 10 is disclosed which generates a stream of steam S for direction against a region of skin of a solon. Apparatus 10 includes a water vessel 20 for retaining a quantity of water having an upright tubular vessel side wall 22 with a vessel rim 22*a* and with a laterally protruding U-shaped handle 26, and having a vessel bottom wall 24 and vessel mounting means 30, and a water heating mechanism 40 mounted outside and in thermal proximity to the vessel 20 including a heating element 42 and power source connection means 44 for generating heat for transfer into the water vessel 20 to heat the quantity of water sufficiently to progressively transform the quantity of water into steam and including a heating mechanism housing 46. Apparatus 10 further includes a steam guidance framework 50 including a substantially horizontal vessel cover structure 60 having a structure upper surface 62 and a structure lower surface 64, vessel engaging means for suspending vessel 20 from the vessel cover structure 60, the vessel cover structure 60 having a steam port 66 above water vessel 20 for passing a stream of steam S as the steam is formed within vessel 20, a steam delivery tube 80 sealingly affixed at a steam delivery tube receiving end 82 to structure upper surface 62 and positioned to enclose steam port 66, the delivery tube 80 preferably protruding upwardly and laterally from structure upper surface 62 to a delivery tube discharge end 84 which includes a steam discharge port 76 for orienting toward the skin of the person to direct a stream of steam S against a selected area of the user skin.

Vessel mounting means 30 preferably includes a vessel supporting flange 22*b* extending radially outwardly from vessel side wall 22 and two opposing and spaced apart mounting flange support channels 70 secured to and extending downwardly from structure lower surface 64, oriented to open toward each other and positioned to simultaneously receive opposing portions of the vessel supporting flange 22*b*. A circular vessel gasket preferably is bonded to structure lower surface 64. Vessel mounting means 30 preferably further includes a vessel clamp 110 affixed to vessel cover structure 60 and protruding downwardly to receive vessel 20 and press vessel 20 upwardly so that vessel flange rim 22*a* sealingly bears against vessel gasket 72. Vessel clamp 110 preferably includes three clamp arms 112, 114 and 116 extending downwardly from structure lower surface 64 and bent at their lower ends toward each other to converge at and join to a clamp screw nut 122 having a vertical and internally threaded clamp screw bore 124 through which a correspondingly threaded clamp shaft 126 rotatably and engagingly passes, the clamp shaft 126 having a shaft lower end fitted with a hand grip dial 132 for manually rotating the clamp shaft 126 and having a shaft upper end rotatably fitted with a vessel abutment element 134 which may take the form of a disk.

Vessel 20 is inserted between clamp arms 112 and 116, and clamp shaft 126 is manually rotated with dial 132 so that clamp shaft 126 advances upwardly to cause vessel abutment element 134 to bear against vessel bottom wall 24 and elevate vessel 20 until the vessel rim 22*a* bears sealingly against the vessel gasket 72 so that steam escaping from vessel 20 is constrained to pass through the steam port 66 and into steam delivery tube 80. When vessel 20 is to be refilled with water or cleaned, clamp shaft 126 is rotated in the opposite rotational direction with hand grip dial 132 so that vessel abutment element 134 advances downwardly and vessel 20 is released from compression and is free for removal from vessel clamp 110. Vessel 20 preferably is formed of stainless steel so that heat from the heating mechanism 40 does not cause vessel 20 to corrode, whether vessel 20 contains distilled or tap water.

The delivery tube 80 optionally includes an ozone receiving port 88 and an ozone generator 140 mounted to the side of delivery tube 80 and in fluid communication with ozone port 142 to pass ozone into the stream of steam S flowing through delivery tube 80 to the steam port 76. The delivery tube discharge end 84 is preferably closed with a tube end wall 92 and the steam discharge port 86 preferably opens out of the side of steam delivery tube 80. Steam delivery tube 80 preferably is formed of two segments, a delivery tube base segment 102 fastened to the structure upper surface 62 and a delivery tube extension segment 104 removably secured to base segment 102 with a tube interconnection structure 94, the base segment 102 including the ozone port 142 and the extension segment 104 including steam discharge port 86. The extension segment 104 preferably includes an extension segment inner tube 104*a* for containing the stream of steam S contained within an axially concentric extension segment outer tube 104*b* sized in diameter and positioned to be spaced radially from the inner tube 104*a* and retained by connection to the tube end wall 92 to provide a heat insulating air gap between the extension segment inner and outer tubes 104*a* and 104*b*, respectively, so that the outer tube is cool enough to be handled for manual positioning of steam discharge port 86. Steam delivery tube 80 preferably is made of CPVC plastic to remain cooler to the touch. The extension segment outer tube 104*b* is also axially rotatable at tube interconnection structure 94 so that the steam discharge port 86 can be manually oriented as desired.

The water heating element 42 preferably is an electrical resistance heating element of conventional design supplied with electricity by a conventional electric circuit. The apparatus includes an apparatus electric circuit 150 having a heating element power on/off control switch 152 and an ozone generator power on/off control switch 154 and electrical power supply wires extending to and from the ozone generator 140, the control switches 152 and 154 having switch actuating buttons extending through a control panel 162 mounted to the vessel cover structure 60. Two power cord plug receptacles preferably are provided, a first plug receptacle 164 for receiving an apparatus power supply cord 166 for plugging into a wall outlet, and a second plug receptacle 172 for receiving an interconnection cord 174 for delivering power from the apparatus electric circuit 150 to the vessel heating element 42.

Vessel cover structure 60 preferably is rectangular and the control panel 162 preferably is joined to and extends upright from one edge of the vessel cover structure 60. A vessel cover structure plug receptacle panel 182 preferably extends upwardly from the opposing edge of vessel cover structure 60, and a housing cover portion 180 having a top wall and two downwardly protruding side walls fits around the control panel 162 and the plug receptacle panel 182 and forms a housing enclosure on top of vessel cover structure 60 containing most of the apparatus electric circuit 150. The housing cover portion 180 includes a steam discharge tube passing port 184.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. An apparatus for generating a stream of steam for direction against an area of skin of a person, the apparatus comprising:

a water vessel for retaining a quantity of water, said vessel having an upright tubular vessel side wall and a vessel bottom wall and vessel mounting means, and a water heating mechanism mounted outside and in thermal proximity to said water vessel comprising a heating element and power source connection means for generating heat for transfer into said water vessel to heat the quantity of water sufficiently to progressively transform the quantity of water into a stream of steam;

a steam guidance framework including a vessel cover structure having a structure upper surface and a structure lower surface, vessel engaging means for suspending said vessel from said vessel cover structure, said vessel cover structure having a steam port over the water vessel for passing a stream of steam from said water vessel;

a steam delivery tube comprising a steam delivery tube receiving end and a steam delivery tube discharge end, said steam delivery tube receiving end being sealingly affixed to said structure upper surface and positioned to enclose said steam port, said steam delivery tube protruding from said structure upper surface to said delivery tube discharge end, said delivery tube discharge end comprising a steam discharge port for orientation toward a selected area of the skin of a person to direct the stream of steam against the selected area of skin;

wherein said vessel mounting means comprises: a vessel supporting flange extending radially outwardly from said vessel side wall; and wherein said vessel engagement means comprises two spaced apart and opposing flange receiving channels secured to and extending from said vessel cover structure, oriented to open toward each other and positioned to receive said vessel supporting flange, vessel gasket means on said vessel cover structure lower surface; and a vessel clamp affixed to and protruding downwardly from said vessel cover structure for receiving said vessel and for pressing said vessel upwardly such that said vessel rim is sealingly pressed against said vessel gasket means.

2. An apparatus for generating a stream of steam for direction against an area of skin of a person, the apparatus comprising:

a water vessel for retaining a quantity of water, said vessel having an upright tubular vessel side wall and a vessel bottom wall;

and a water heating mechanism mounted outside and in thermal proximity to said water vessel comprising a heating element and power source connection means for generating heat for transfer into said water vessel to heat a quantity of water retained within said water vessel sufficiently to progressively transform the quantity of water into a stream of steam;

a steam guidance framework comprising a vessel cover structure having a structure upper surface and a structure lower surface, said vessel cover structure having a steam port over the water vessel for passing a stream of steam from said water vessel;

a steam delivery tube comprising a steam delivery tube receiving end and a steam delivery tube discharge end, said steam delivery tube receiving end being sealingly affixed to said structure upper surface and positioned to enclose said steam port, said steam delivery tube protruding from said structure upper surface to said delivery tube discharge end, said delivery tube discharge end comprising a steam discharge port for orientation toward a selected area of the skin of a person to direct the stream of steam against the selected area of skin;

at least one clamp arm having an arm lower end and extending downwardly from said vessel cover structure and bent to extend underneath said vessel at which is connected a clamp screw nut structure having an upright and internally threaded clamp screw bore;

and a threaded clamp shaft rotatably and engagingly passing through said screw bore, said clamp shaft having a shaft lower end for rotating said clamp shaft and having a shaft upper end;

such that said vessel is insertable adjacent to said at least one clamp arm, and said clamp shaft is rotated such that said clamp shaft advances upwardly to cause said shaft upper end to bear against said vessel and elevate said vessel until said vessel rim bears sealingly against said vessel gasket means such that steam escaping from said vessel is constrained to pass through said steam port and into said steam delivery tube, and such that said clamp shaft is rotatable in the opposite rotational direction with said hand grip means and said shaft upper end advances downwardly and said vessel is released from compression and freed for removal from said vessel clamp.

3. The apparatus of claim 2, wherein said vessel is formed of stainless steel such that said vessel is resistant to corrosion induced by heat from said heating element.

4. An apparatus for generating a stream of steam for direction against an area of skin of a person, the apparatus comprising:

a water vessel for retaining a quantity of water, said vessel having an upright tubular vessel side wall and a vessel bottom wall and having vessel mounting means, and having a water heating mechanism mounted outside and in thermal proximity to said water vessel comprising a heating element and power source connection means for generating heat for transfer into said water vessel to heat the quantity of water sufficiently to progressively transform the quantity of water into a stream of steam;

a steam guidance framework including a vessel cover structure having a structure upper surface and a structure lower surface, vessel engaging means for engaging said vessel mounting means and thereby suspending said vessel from said vessel cover structure, said vessel cover structure having a steam port over the water vessel for passing a stream of steam from said water vessel;

a steam delivery tube comprising a heat resistant plastic and a steam delivery tube receiving end and a steam delivery tube discharge end, said steam delivery tube receiving end being sealingly affixed to said structure upper surface and positioned to enclose said steam port, said steam delivery tube protruding from said structure upper surface, said delivery tube discharge end comprising a steam discharge port for orientation toward a selected area of the skin of a person to direct the stream of steam against the selected area of skin;

an ozone receiving port in said steam delivery tube and an ozone generator positioned to delivery ozone into said ozone receiving port for passing ozone into the stream of steam flowing through said steam delivery tube;

wherein said steam delivery tube comprises a delivery tube base segment fastened to said vessel cover structure and a delivery tube extension segment secured to said base segment with a tube interconnection structure, said base segment comprising said ozone receiving port and said extension segment comprising said steam discharge port;

wherein said extension segment comprises an extension segment inner tube for containing the stream of steam and an axially concentric extension segment outer tube containing said extension segment inner tube and sized in diameter and positioned to be spaced radially outward from said inner tube for providing a heat insulating air gap between said extension segment inner tube and said extension segment outer tube such that said outer tube is cool enough to be handled for manual positioning of said steam discharge port;

and wherein said extension segment is axially rotatable at said tube interconnection structure to orient said steam discharge port.

* * * * *